US010636256B2

(12) United States Patent
Nelson et al.

(10) Patent No.: US 10,636,256 B2
(45) Date of Patent: Apr. 28, 2020

(54) SYSTEM AND METHOD FOR PROVIDING A GAME WITH UNFOLDING SYMBOLS

(71) Applicant: VIDEO GAMING TECHNOLOGIES, INC., Franklin, TN (US)

(72) Inventors: Lyndsay Nelson, Reno, NV (US); Ryan Cuddy, Reno, NV (US); Zachary Schmid, Sparks, NV (US)

(73) Assignee: VIDEO GAMING TECHNOLOGIES, INC., Franklin, TN (US)

( * ) Notice: Subject to any disclaimer, the term of this patent is extended or adjusted under 35 U.S.C. 154(b) by 0 days.

(21) Appl. No.: 16/123,435

(22) Filed: Sep. 6, 2018

(65) Prior Publication Data

US 2019/0005780 A1 Jan. 3, 2019

Related U.S. Application Data

(63) Continuation of application No. 14/497,940, filed on Sep. 26, 2014, now Pat. No. 10,096,211.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
None
See application file for complete search history.

(56) References Cited

U.S. PATENT DOCUMENTS 5,564,700 A * 10/1996 Celona ..... G07F 17/32 463/20
6,059,658 A * 5/2000 Mangano ..... A63F 5/04 463/16
6,227,972 B1 * 5/2001 Walker ..... G06Q 20/204 235/380
7,014,559 B1 3/2006 Fong
7,553,231 B2 6/2009 Rodgers et al.
7,758,414 B1 7/2010 Marks et al.
8,105,145 B2 1/2012 Jaffe
8,226,468 B2 7/2012 Hoffman et al.
(Continued)

OTHER PUBLICATIONS

AU Examination Report for AU Application No. 2017235982, dated Jun. 13, 2018. 4 Pages.

*Primary Examiner* — Tramar Y Harper
(74) *Attorney, Agent, or Firm* — Armstrong Teasdale LLP

(57) ABSTRACT

A gaming machine includes a credit input mechanism, a display, a processor, and a memory device storing instructions which, when executed by the processor, cause the processor to at least display a plurality of reels, each of the plurality of reels comprising a plurality of symbol display positions, establish a credit balance in response to a receipt of a credit input via the credit input mechanism, initiate a play of a game in response to a wager, for at least one of the plurality of symbol display positions for each of the plurality of reels, determine and display a symbol from a set of symbols, determine that a first unfolding of the first instance of the unfolding symbol should occur based on a first probability, and expand the active play area beyond the border based on the first instance of the unfolding symbol appearing adjacent to the border.

20 Claims, 7 Drawing Sheets

(56) References Cited

U.S. PATENT DOCUMENTS 8,784,176 B2 7/2014 Ryan
8,939,832 B2 1/2015 Ryan
2003/0050111 A1* 3/2003 Saffari ..... G06Q 30/0207 463/25
2003/0203752 A1 10/2003 Kaminkow et al.
2004/0209673 A1* 10/2004 Shiraishi ..... G07F 17/3211 463/20
2005/0037845 A1* 2/2005 Rozkin ..... G07F 17/3227 463/42
2005/0130731 A1* 6/2005 Englman ..... G07F 17/32 463/20
2005/0159208 A1* 7/2005 Pacey ..... G07F 17/3211 463/20
2008/0108411 A1 5/2008 Jensen et al.
2008/0132326 A1* 6/2008 Seelig ..... G07F 17/3202 463/20
2008/0188286 A1 8/2008 Jaffe
2008/0200235 A1* 8/2008 Yoshizawa ..... G07F 17/3267 463/20
2009/0069071 A1 3/2009 Aoki et al.
2009/0239631 A1 9/2009 Aoki et al.
2009/0270165 A1* 10/2009 Dias Pires ..... G07F 17/32 463/20
2009/0325678 A1 12/2009 Gomez
2010/0016061 A1 1/2010 Gomez et al.
2010/0298041 A1* 11/2010 Berman ..... G07F 17/3265 463/20
2011/0034234 A1 2/2011 Berman et al.
2011/0105215 A1 5/2011 Mizue
2013/0035150 A1* 2/2013 Owen ..... G07F 17/3265 463/20
2013/0035151 A1* 2/2013 Owen ..... G07F 17/3244 463/20
2013/0065663 A1* 3/2013 Johnson ..... G07F 17/3213 463/20
2013/0102375 A1* 4/2013 Aoki ..... G07F 17/32 463/20
2013/0237307 A1 9/2013 Wotton et al.
2013/0324208 A1 12/2013 Ryan
2014/0162750 A1 6/2014 Ryan
2014/0179398 A1 6/2014 Vandaele
2014/0194183 A1 7/2014 Pierer et al.
2014/0248938 A1 9/2014 Tidke
2014/0256402 A1 9/2014 Caputo et al.
2014/0287812 A1 9/2014 Friedman et al.
2014/0323198 A1 10/2014 Tuck
2014/0335946 A1 11/2014 Fujisawa et al.
2015/0161853 A1 6/2015 Ryan
2015/0348363 A1 12/2015 Johnson et al.
2017/0039817 A1 2/2017 Suda

* cited by examiner

SYSTEM AND METHOD FOR PROVIDING A GAME WITH UNFOLDING SYMBOLS

CROSS-REFERENCE TO RELATED APPLICATIONS

This application is a continuation of U.S. patent application Ser. No. 14/497,940, filed Sep. 26, 2014, the entire contents and disclosure of which are hereby incorporated by reference in their entirety.

BACKGROUND

The embodiments described herein relate generally to gaming systems and methods that provide games of chance and, more particularly, to systems and methods for providing a game of chance with unfolding symbols.

Conventionally, gaming machines provide games wherein a player has one or more opportunities to obtain a winning symbol combination on mechanical or video reels. At least some known games have a predetermined number of winning symbol combinations based on a predetermined set of symbols.

BRIEF DESCRIPTION

In one aspect, a gaming machine for providing a game of chance operable upon a wager by a player is provided. The gaming machine includes a plurality of reels associated with the game of chance. Each of the plurality of reels includes a plurality of reel positions to generate a symbol thereon. The gaming machine also includes a display including a defined plurality of positions to present a symbol thereon for each of the plurality of reels. The gaming machine also includes a processor. The processor is programmed to generate a spin of the plurality of reels. The spin results in a play area including one or more symbols generated from each of the plurality of reels. The processor is also programmed to identify a first unfolding symbol in a first position on the play area. The processor is further programmed to determine a second position on the play area adjacent to the first position. The processor is also programmed to display a second unfolding symbol in the second position on based at least in part on the determining, thereby unfolding the first unfolding symbol.

In another aspect, a method for providing a game of chance on a gaming machine comprising a display and a plurality of reels associated with the game of chance is provided. Each of the plurality of reels includes a plurality of reel positions for generating a symbol thereon. The method includes generating a spin of the plurality of reels. The spin resulting in a play area including one or more symbols generated from each of the plurality of reels. The method also includes identifying a first unfolding symbol in a first position on the play area. The method further includes determining a second position on the play area adjacent to the first position. The method also includes displaying a second unfolding symbol in the second position on based at least in part on the determining, thereby unfolding the first unfolding symbol.

In yet another aspect, a gaming system is provided. The gaming machine includes a gaming machine. The gaming machine includes a plurality of reels associated with a game of chance. Each of the plurality of reels includes a plurality of reel positions to generate a symbol thereon. The gaming machine also includes a display comprising a defined plurality of positions to present a symbol thereon for each of the plurality of reels. The gaming system also includes a server. The server includes a processor. The processor is programmed to generate a spin of the plurality of reels. The spin results in a play area including one or more symbols generated from each of the plurality of reels. The processor is also programmed to identify a first unfolding symbol in a first position on the play area. The processor is further programmed to determine a second position on the play area adjacent to the first position. The processor is also programmed to display a second unfolding symbol in the second position on based at least in part on the determining, thereby unfolding the first unfolding symbol.

BRIEF DESCRIPTION OF THE DRAWINGS

The embodiments described herein may be better understood by referring to the following description in conjunction with the accompanying drawings.

DETAILED DESCRIPTION

Figure 1:
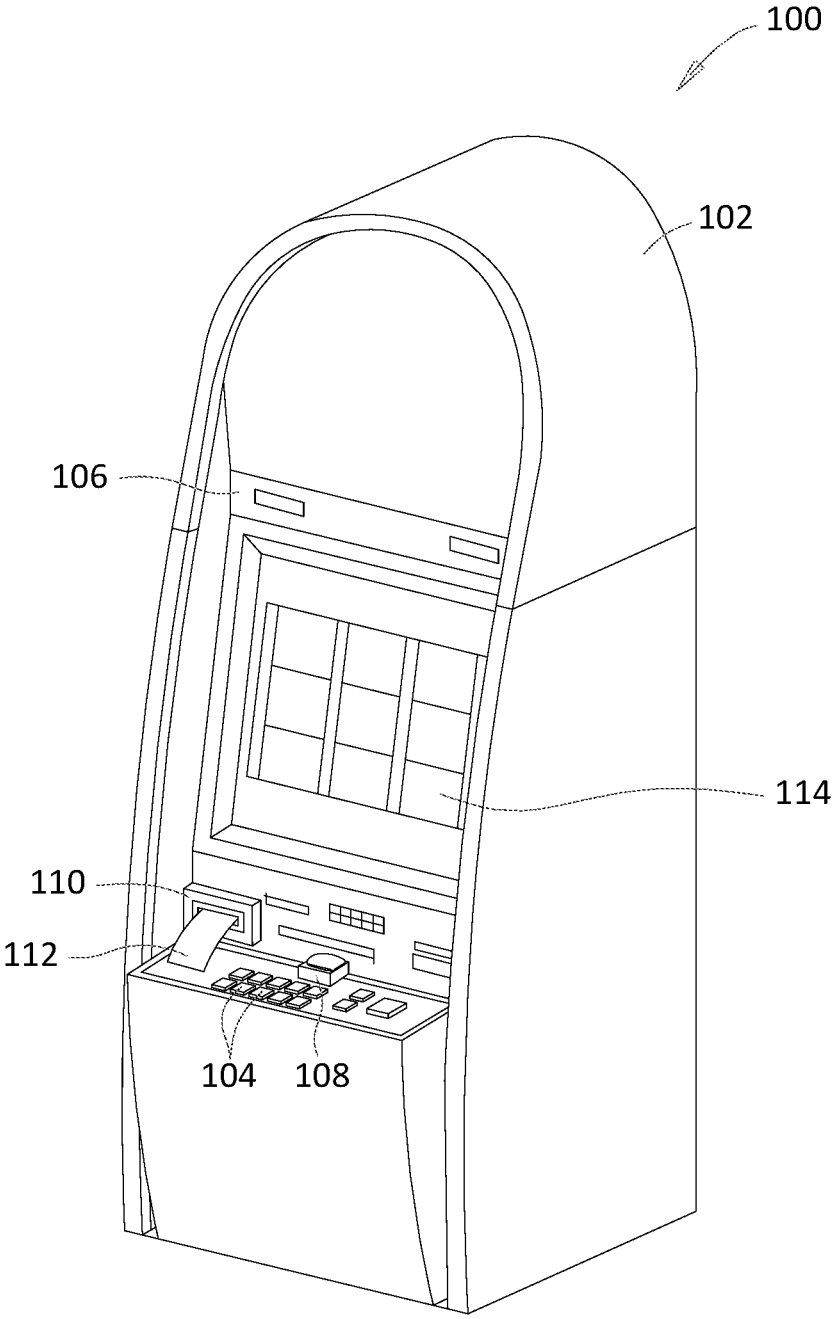
FIG. 1 is a schematic diagram of an exemplary gaming machine that enables play of a base game that includes unfolding symbols.

The embodiments described herein relate generally to gaming systems and methods that provide games of chance to a player operating a gaming machine and, more particularly, to systems and methods for providing a game of chance with unfolding symbols during game play. In one example embodiment, the gaming machine generates a spin of a plurality of reels (e.g., virtual reels). One or more of the reels include one or more special symbols, or "unfolding symbols", that trigger an unfolding process. After the spin is complete, the gaming machine performs the unfolding process on an exposed unfolding symbol.

In one embodiment, the unfolding process includes replicating, or "unfolding", one already-displayed unfolding symbol into another adjacent position. In other words, a copy of the unfolding symbol is placed into or displayed in a neighboring position on the play area. That new unfolding symbol is then also similarly unfolded. As such, the gaming machine may generate up to four additional unfolding symbols from one original unfolding symbol.

At least one of the technical problems addressed by this system includes: (i) overcoming computer-generated game content that is stale or unexciting to users; (ii) fixed-reel, fixed-position games providing limited variability or flexibility in game content and/or game action; and (iii) limited award potential based on fixed symbol positions.

A technical effect of the systems and processes described herein is achieved by performing at least one of the following steps: (a) generating a spin of the plurality of reels, the spin resulting in a play area including one or more symbols generated from each of the plurality of reels; (b) identifying a first unfolding symbol in a first position on the play area; (c) determining a second position on the play area adjacent to the first position; (d) displaying a second unfolding symbol in the second position on based at least in part on the determining, thereby unfolding the first unfolding symbol; (e) determining a set of adjacent spaces that are adjacent to the first position; (f) randomly selecting the second position from the set of adjacent spaces; (g) displaying a third unfolding symbol in a third position adjacent to one or more of the first position and the second position on the play area; (h) displaying a third unfolding symbol based in part on a random chance determination; (i) pre-designating the unfolding symbol as a wild symbol; (j) determining the unfolding symbol during play based at least in part on the appearance of the unfolding symbol in a pre-determined position on the play area; (k) expanding the play area based at least in part on where, on the play area, the second unfolding symbol is displayed; (l) determining a set of adjacent spaces that are adjacent to the second position, the set of adjacent spaces including one or more adjacent spaces in an expansion area of the play area; (m) selecting an adjacent space in the expansion area as the third position, thereby selecting an expansion position; and (n) expanding the play area based at least in part on the selecting of the expansion position.

The technical effect achieved by this system is at least one or more of: (i) replicating an existing symbol on the play area, thereby providing more of those symbols on the play area; (ii) altering the symbols on the play area during or after a spin; (iii) increasing the play area during the game; (iv) displaying the unfolding effects to the user during the play; and (v) increasing award combinations.

FIG. 1 is a schematic diagram of an exemplary gaming machine 100 that enables play of a base game that includes unfolding symbols. Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a cabinet 102 configured to house a plurality of components, such as a gaming machine controller, peripheral devices, presentation devices, and player interaction devices. For example, in an exemplary embodiment, gaming machine 100 includes a plurality of input devices, such as switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher, which corresponds to a number of remaining credits.

In the exemplary embodiment, gaming machine 100 also includes a coin acceptor 108 for accepting coins and/or tokens, and a bill acceptor 110 for accepting and/or validating cash bills, coupons, and/or ticket vouchers 112. Bill acceptor 110 may also be capable of printing tickets 112. Furthermore, in some embodiments, bill acceptor 110 includes a card reader or validator for use with credit cards, debit cards, identification cards, and/or smart cards. The cards accepted by bill acceptor 110 may include a magnetic strip and/or a preprogrammed microchip that includes a player's identification, credit totals, and any other relevant information that may be used. Moreover, in the exemplary embodiment, gaming machine 100 includes one or more presentation devices 114. Presentation devices 114 are mounted to cabinet 102, and may include a primary presentation device for displaying a primary game and a secondary presentation device for displaying a secondary or bonus game. Presentation devices 114 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user.

In an exemplary embodiment, presentation device 114 is used to display one or more game images, symbols, and/or indicia such as a visual representation or exhibition of movement of an object (e.g., a mechanical, virtual, or video reel), dynamic lighting, video images, and the like. In an alternative embodiment, presentation device 114 displays images and indicia using mechanical means. For example, presentation device 114 may include an electromechanical device, such as one or more rotatable reels, to display a plurality of game or other suitable images, symbols, or indicia.

In one embodiment, gaming machine 100 randomly generates game outcomes using probability data. For example, each game outcome is associated with one or more probability values that are used by gaming machine 100 to determine the game output to be displayed. Such a random calculation may be provided by a random number generator, such as a true random number generator (RNG), a pseudo-random number generator (PNG), or any other suitable randomization process.

Figure 2:
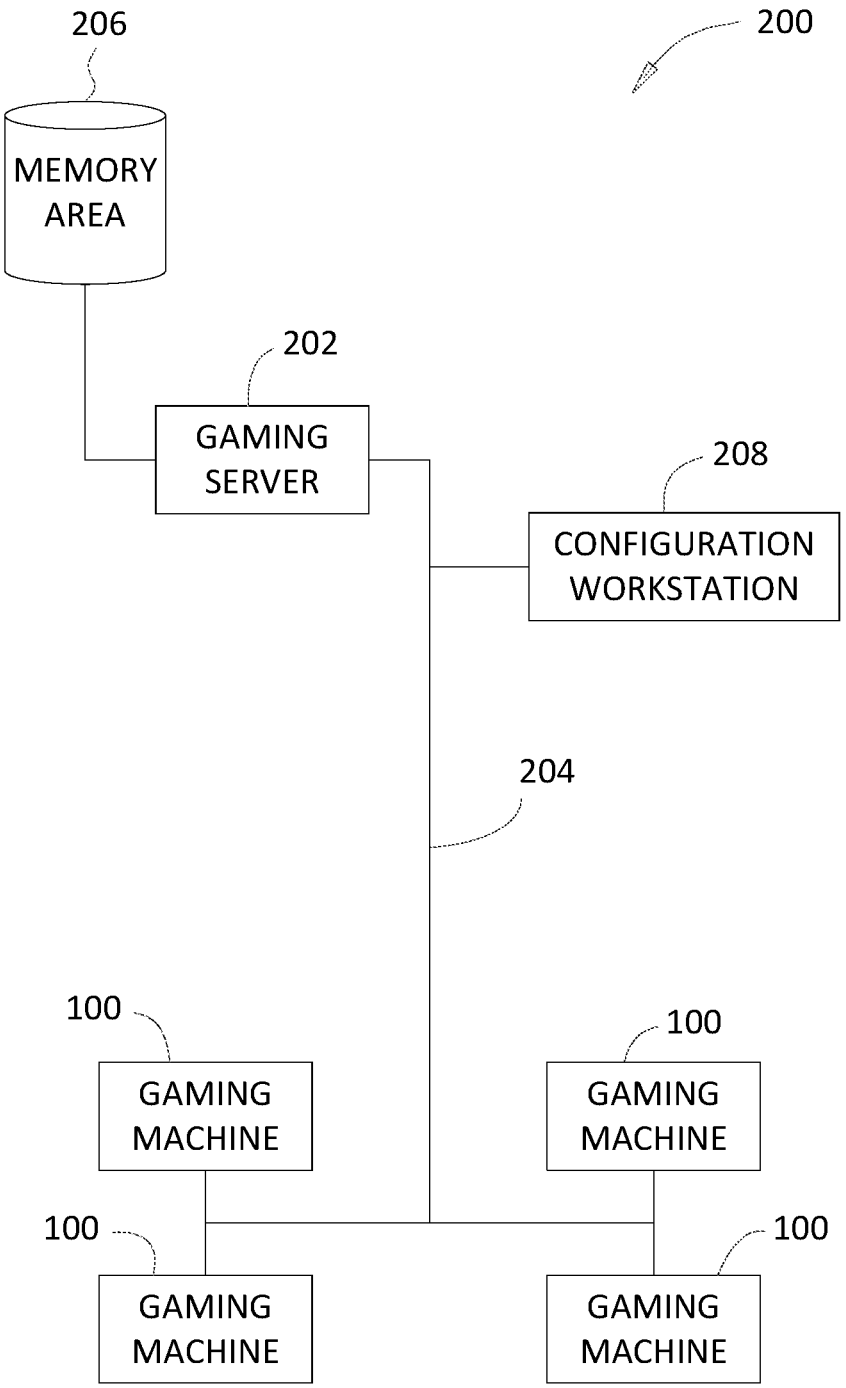
FIG. 2 is a block schematic diagram of an exemplary gaming system that includes a plurality of gaming machines, such as the gaming machine shown in FIG. 1.

FIG. 2 is a block schematic diagram of an exemplary gaming system 200 that includes a plurality of gaming machines, such as gaming machine 100 (shown in FIG. 1). Each gaming machine 100 is coupled via communication interface (not shown in FIG. 2) to one or more servers, such as a gaming server 202, using a network 204. Gaming server 202 includes a processor (not shown) that facilitates data communication between each gaming machine 100 and other components of gaming system 200. Such data is stored in, for example, a memory area 206, such as a database or a file system, which is coupled to gaming server 202.

In one embodiment, one or more gaming machines 100 may be remote gaming machines that access a casino over network 204. As such, a player is able to participate in a game of chance on a remote gaming machine while a player proxy is physically present at, for example, a casino or some other location. In this embodiment, it will be understood that a player operating a remote gaming machine has virtual access to any casino coupled to network 204 and associated with gaming server 202. Further, while gaming machines 100 are described herein as video bingo machines, video poker machines, video slot machines, and/or other similar gaming machines that implement alternative games, gaming machines 100 may also be a personal computers coupled to the Internet or to a virtual private network such that a player may participate in a game of chance remotely. In other embodiments, the player may use a cell phone or other web enabled devices coupled to a communication network to establish a connection with a particular casino. Moreover, gaming machines 100 may be terminal-based machines, wherein the actual games, including random number generation and/or outcome determination, are performed at gaming server 202. In such an embodiment, gaming machines 100 display results of a game via presentation device 114 (shown in FIG. 1).

In one embodiment, gaming server 202 performs a plurality of functions including, for example, game outcome generation, executing a game play event for a player, player proxy selection, player tracking functions, and/or accounting functions, and data authentication functions, to name a few. However, in alternative embodiments, gaming system 200 may include a plurality of servers that separately perform these functions and/or any suitable function for use in a network-based gaming system.

Figure 3:
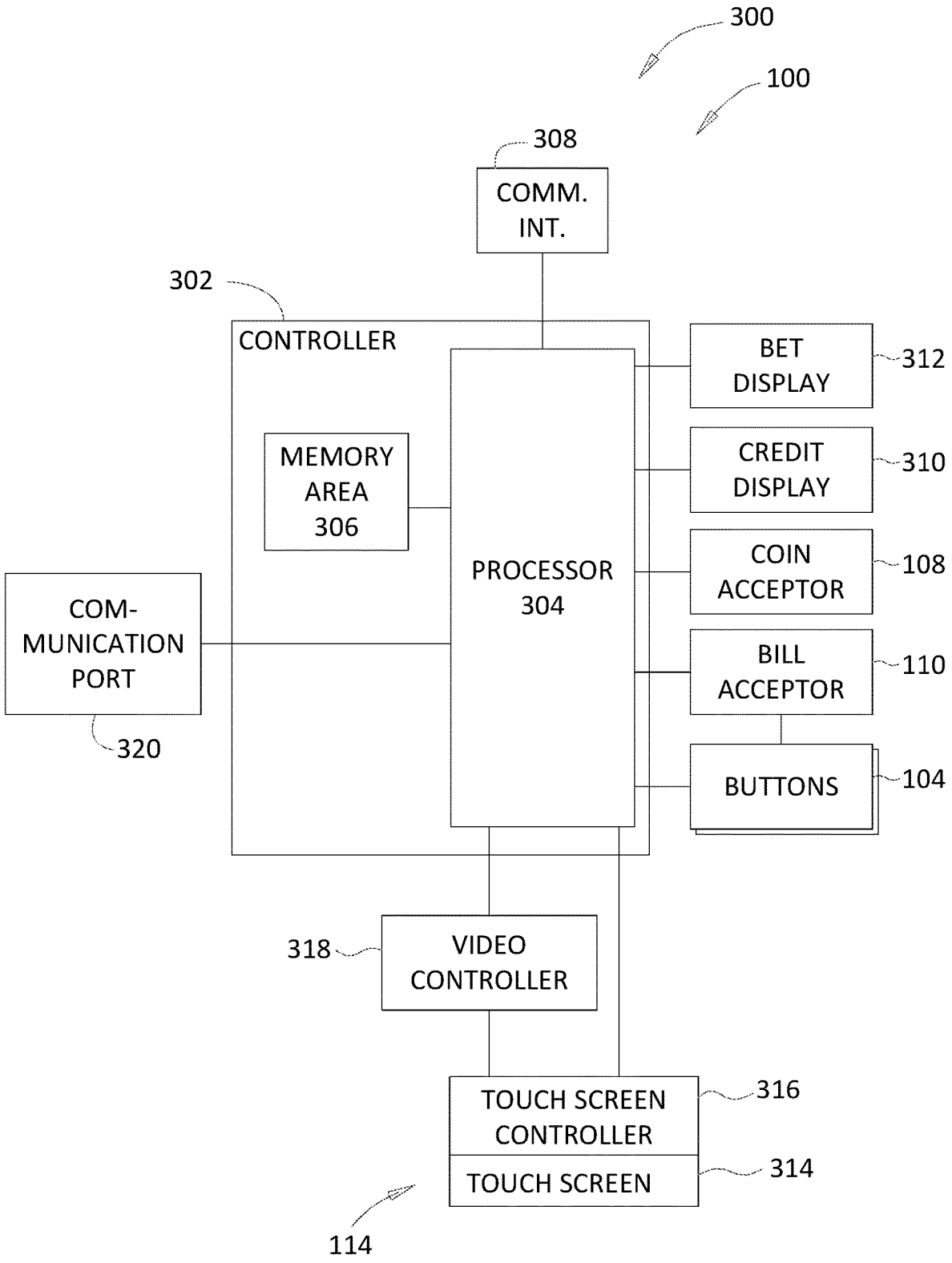
FIG. 3 is a schematic block diagram of an exemplary electrical architecture that may be used with the gaming machines shown in FIGS. 1 and 2.

FIG. 3 is a schematic block diagram of an exemplary electrical architecture 300 that may be used with gaming machine 100. In the exemplary embodiment, gaming machine 100 includes a gaming machine controller 302 including a processor 304 communicatively coupled to a memory area 306. Moreover, in the exemplary embodiment, processor 304 and memory area 306 reside within cabinet 102 (shown in FIG. 1), and may be collectively referred to herein as a "computer" or "controller." Gaming machine 100 is configurable and/or programmable to perform one or more operations described herein by programming processor 304. For example, processor 304 may be programmed by encoding an operation as one or more executable instructions and providing the executable instructions in memory area 306.

Controller 302 communicates with one or more other gaming machines 100, gaming servers 202 (shown in FIG. 2), or other suitable devices via a communication interface 308. Communication interface 308 may operate as an input device (e.g., by receiving data from another device) and/or as an output device (e.g., by transmitting data to another device). Processor 304 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor."

Memory area 306 stores at least program code and instructions, executable by processor 304, for controlling gaming machine 100. For example, memory area 306 stores data such as image data, event data, player input data, random or pseudo-random number generation software, pay table data, trigger event conditions, game play events, a list of predefined periods of time to execute the game play events, game play outcomes, data authentication functionality, and/or other information or applicable game rules that relate to game play on gaming machine 100. Moreover, memory area 306 may include one or more forms of memory. For example, memory area 306 can include random access memory (RAM), read-only memory (ROM), flash memory, and/or electrically erasable programmable read-only memory (EEPROM). In some embodiments, other suitable magnetic, optical, and/or semiconductor-based memory may be included in memory area 306 by itself or in combination. In one embodiment, the above data and program code and instructions, executable by processor 304 for authenticating data may be stored and executed from a memory area remote from computing device gaming machine 100. For example, the data and the computer-executable instructions may be stored in a cloud service, a database, or other memory area accessible by gaming machine 100. Such embodiments reduce the computational and storage burden on gaming machine 100. As such, memory area 306 may be a local and/or a remote computer storage media including memory storage devices.

In the exemplary embodiment, gaming machine 100 includes a credit display 310, which displays a player's current number of credits, cash, account balance or the equivalent. Gaming machine 100 also includes a bet display 312, which displays a player's amount wagered. Credit display 310 and bet display 312 may be standalone displays independent of presentation device 114, or credit display 310 and bet display 312 may be incorporated into presentation device 114.

Moreover, in an exemplary embodiment, presentation device 114 is controlled by controller 302. In some embodiments, presentation device 114 includes a touch screen 314 and an associated touch screen controller 316. In such embodiments, presentation device 114 may operate as an input device in addition to presenting information. A video controller 318 is communicatively coupled to controller 302 and touch screen controller 316 to enable a player to input game play decisions (e.g., actions) into gaming machine 100 via touch screen 314. Furthermore, gaming machine 100 includes one or more communication ports 320 that enable controller 302 to communicate with external peripheral devices (not shown) such as, but not limited to, external video sources, expansion buses, other displays, a SCSI port, or a key pad.

Figure 4:
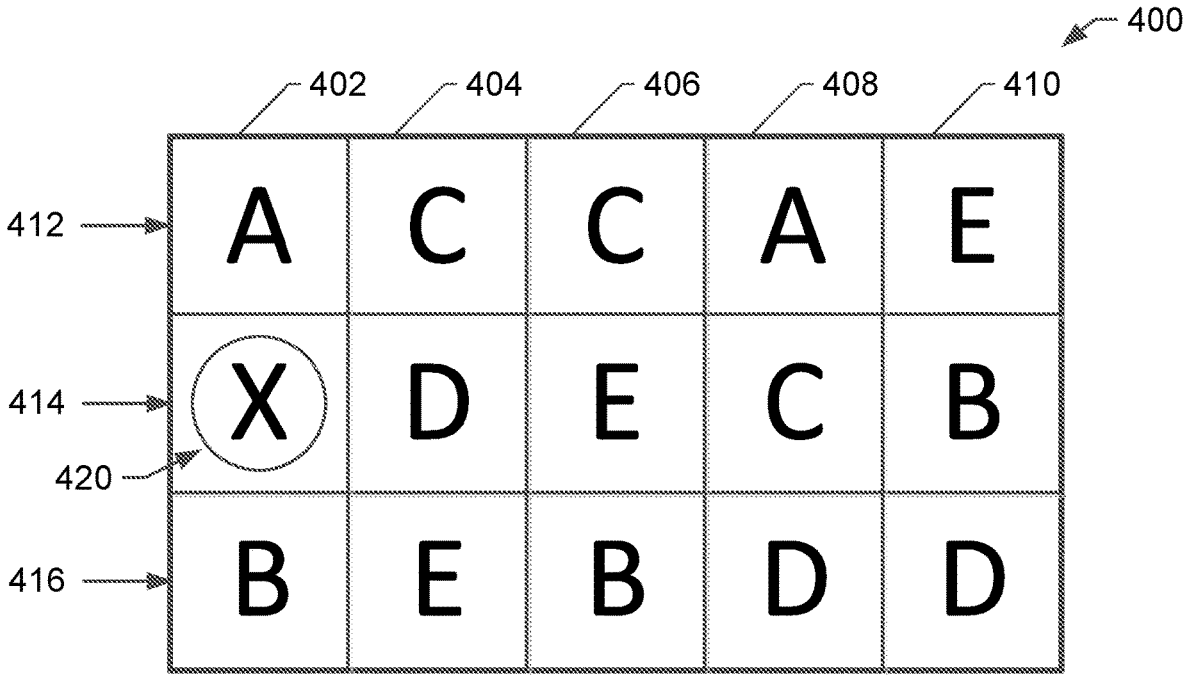
FIG. 4 is a screen view of an exemplary game of chance provided on a primary display that includes unfolding symbols.

FIG. 4 is a screen view 400 of an exemplary game of chance provided on primary display 114 that includes unfolding symbols. In the example embodiment, the game of chance includes five reels (not completely shown), physical, virtual, or otherwise. Each reel includes a plurality of symbol positions, wherein each symbol position is associated with at least one particular symbol. A play of the game of chance, in some embodiments, includes at least one simulated spin of one or more of the reels. Each spin results in the display of three contiguous symbol positions of each virtual reel, illustrated here by columns 402, 404, 406, 408, and 410, such that one symbol for each reel is displayed in each row 412 of view 400. It should be understood that more or less reels may be used, and more or less positions per reel may be shown in the play area within the scope of this disclosure.

In the example embodiment, all five reels are "virtual reels" simulated by gaming machine 100 (shown in FIG. 1) during the game of chance. In other words, and for example, the five reels are generated by gaming machine 100 (shown in FIG. 1) in memory prior to game play. As such, each position displayed on the display may be modified or overwritten by gaming machine 100 during the course of gameplay. In this example, the game of chance uses a pre-determined set of symbols ("symbol set") to populate the five reels: "A", "B", "C", "D", "E", and "X". The "X" symbol of these examples is an "unfolding symbol", as further described herein, and is circled in some figures merely for illustrative purposes. It should be understood that the symbols used in this example symbol set are chosen merely for purposes of discussion. Any symbols may be used as symbol set, and any one or more of those symbols may be implemented as an unfolding symbol.

In some embodiments, one or more symbols from the symbol set are pre-designated as "unfolding symbols", or symbols associated with the unfolding process. In the exemplary embodiment, the "X" is pre-designated as the only unfolding symbol. In other embodiments, one or more symbols from the symbol set may be randomly assigned as unfolding symbols either prior to or during play of the game. In still other embodiments, one or more symbols may be determined to be an unfolding symbol during the course of play. For example, in one embodiment, a symbol appearing in a particular position on the play area may become an unfolding symbol (i.e., based on its appearance at that particular position). In some embodiments, the unfolding symbol may also be a special symbol, such as a "wild" symbol that may be treated as any one or more of the other symbols in the symbol set during award evaluation, or a "major" symbol that may be more highly valued by the player and/or awarded higher than other symbols.

In the exemplary embodiment, gaming machine 100 spins the five reels during a first spin to generate exposed symbol positions, for example, as shown in screen view 400. After the first spin is complete (e.g., entirely displayed to the user), gaming machine 100 processes unfolding of one or more exposed unfolding symbols (e.g., "X"). The process of "unfolding" a symbol, generally speaking, includes identifying an exposed unfolding symbol after a spin, then potentially replicating that symbol one or more times. The term "original unfolding symbol", as used herein, means an unfolding symbol originally exposed after a spin, prior to performing an unfolding process for that spin. The term "additional unfolding symbol" means an unfolding symbol that was not originally exposed after a spin, but rather that was generated by the unfolding process as described herein. The unfolding process is described in greater detail below. In the example spin results shown in FIG. 4, there is only one original unfolding symbol 420 exposed.

Figure 5:
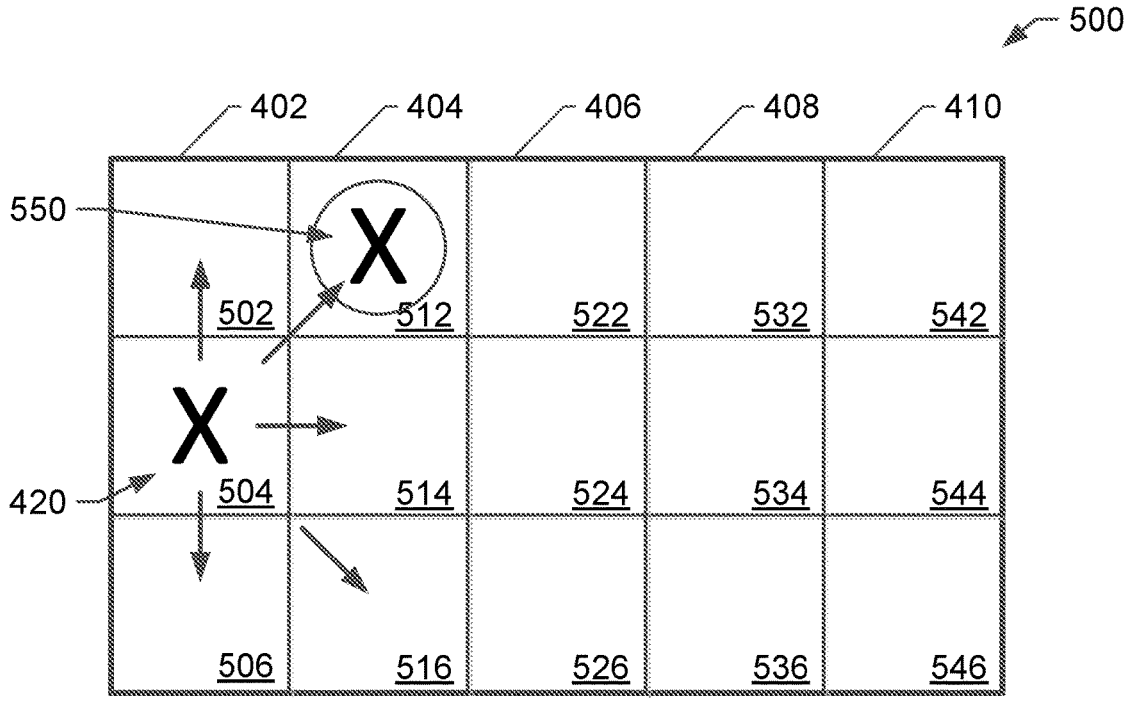
FIG. 5 is a screen view of an exemplary game of chance provided on primary display that includes unfolding symbols, such as the original unfolding symbol shown in FIG. 4.

FIG. 5 is a screen view 500 of an exemplary game of chance provided on primary display 114 that includes unfolding symbols, such as original unfolding symbol 420. Screen view 500, in this example, illustrates a display similar to screen view 400 (shown in FIG. 4), but with only the original unfolding symbol shown for purposes of illustration. Further, each individual symbol position in screen view 500 is individually identified. For example, first column 402 includes a top position 502, a middle position 504, and a bottom position 506, and so on for second through fifth columns 404, 406, 408, and 410.

In the exemplary embodiment, gaming machine 100 performs an overall unfolding processes that includes unfolding each original unfolding symbol exposed by a spin. The unfolding process includes one or more individual "unfolds", as described below. In this example, the only original unfolding symbol exposed by the spin, e.g., original unfolding symbol 420 in position 504. More specifically, gaming machine 100 performs a first unfold of original unfolding symbol 420 into a single adjacent symbol position, such as position 502, 512, 514, 516, or 506. As used herein, the term "potential unfolding position set" is used to describe a set of positions that are destination candidates for the unfolding process. In other words, each position in a potential unfolding position set is available to receive a copy of the unfolding symbol, referred to herein as an "additional unfolding symbol." In the example embodiment, during the first unfold of this unfolding process (e.g., the unfolding of original unfolding symbol 420), gaming machine 100 identifies the positions 502, 512, 514, 516, or 506 as the potential unfolding position set.

In the example embodiment, during the first unfold, gaming machine 100 selects a random position from the potential unfolding position set (position 512 in the example shown in FIG. 5). As such, gaming machine 100 populates this destination position 512 with an unfolding symbol ("additional unfolding symbol") 550. In other words, gaming machine 100 overwrites or replaces the symbol that previously occupied the destination position 512 with the additional unfolding symbol 550. As used herein, the term "source position" is used to refer to the position from which unfolding started in the current unfold (position 504 in this example). The term "destination position" is used to refer to the position selected for unfolding, or the position into which an additional unfolding symbol will be populated (position 512 in this example). In other words, the destination position is the position selected from the potential unfolding position set. Once complete, a "single unfold" (e.g., the first unfold from the first original unfolding symbol) has occurred. In some embodiments, gaming machine 100 only unfolds in one direction, such as from left to right. For example, the potential unfolding position set may only include adjacent spaces (e.g., positions 522 and 524) on the reel just to the right (e.g., reel 406) of the current unfolding symbol being processed (e.g., additional symbol 550).

In some embodiments, each original unfolding symbol 504 is processed with a single unfold (e.g., one additional unfolding symbol 550). In other embodiments, such as described below in reference to FIG. 6, gaming machine 100 performs multiple unfolds from an original unfolding symbol during the unfolding process. In other words, original unfolding symbol 420 may be directly unfolded more than once, such as generating both additional unfolding symbol 550 in position 512 and another additional unfolding symbol (not shown) in, for example, position 516.

Figure 6:
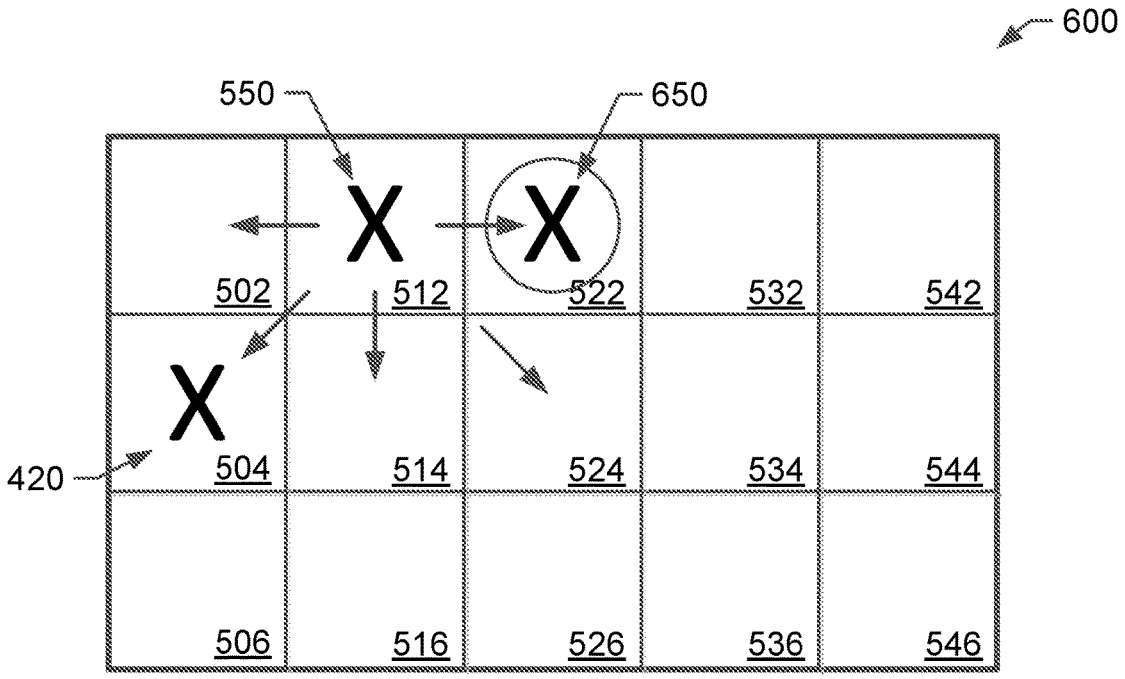
FIG. 6 is a screen view of a "fixed-size playing screen" embodiment described, by way of example, as a continuation of the exemplary game of chance described in reference to FIGS. 4 and 5.

FIG. 6 is a screen view 600 of a "fixed-size playing screen" embodiment described, by way of example, as a continuation of the exemplary game of chance described in reference to FIGS. 4 and 5. In the exemplary embodiment, gaming machine 100 (shown in FIG. 1) performs a second unfold during the unfolding process associated with original unfolding symbol 420. More specifically, gaming machine 100 performs a second unfold based off of the additional unfolding symbol 550 generated from the prior unfold. In other words, the second unfold will be performed with additional unfolding symbol 550 as the source position (e.g., position 512). As such, gaming machine 100 determines the potential unfolding position set for this second unfold as the positions 522, 524, 514, and 502. In the example embodiment, position 504 is adjacent to the source position, but is excluded from the potential unfolding position set because that position already contains an unfolding symbol (e.g., original unfolding symbol 420). In some embodiments, position 504 may be included in potential unfolding position set and, if selected as a destination position, processed as described herein (e.g., overwriting original unfolding symbol 420 with, or additionally displaying, an additional unfolding symbol). In other embodiments, selecting a position (e.g., position 504) already containing an unfolding symbol causes gaming machine 100 to add an additional unfolding symbol to that position. In other words, and for example, a second unfolding symbol may be displayed in position 504.

In the example shown in FIG. 6, gaming machine 100 randomly selects position 522 from the potential unfolding position set, overwrites position 522 with an additional unfolding symbol 650, and thus completes the second unfolding associated with original unfolding symbol 420. In the exemplary embodiment, gaming machine 100 processes a third and fourth unfolding associated with original unfolding symbol 420. In other words, position 522 becomes the source position for a third unfold, and the destination position selected for that third unfold becomes the source position for a fourth unfold. Once the fourth unfold associated with original unfolding symbol 420 is complete, no further unfolds associated with original unfolding symbol 420 are performed.

In the exemplary embodiment, as a part of the unfolding process, gaming machine 100 similarly unfolds any other original unfolding symbols not yet processed. In other words, all original unfolding symbols are unfolded. In the example, there are no other original unfolding symbols as a result of the first spin. As such, the unfolding process is complete. In other embodiments, gaming machine 100 unfolds only a pre-determined number of original unfolding symbols. In still other embodiments, gaming machine 100 unfolds only original unfolding symbols originally appearing on a pre-determined one or more reels, such as just first reel 402 (shown in FIGS. 4 & 5), or in a pre-determined position or set of positions on the play area, such as position 504.

Once all unfolding has been processed, gaming machine 100 evaluates pay lines and determines awards or rewards using the positions as modified by the unfolding process. Accordingly, in the exemplary embodiment, the unfolded symbols are used to potentially increase the awards or rewards to the player.

In some embodiments, there is a chance, at each unfold level, that the unfold at that level will not occur. Put another way, and in the example embodiment, each original unfold symbol may generate from none to four unfolds. For example, in one embodiment, gaming machine 100 identifies a pre-defined chance of unfolding ("fixed unfolding chance"), such as 15%. As such, gaming machine 100 will only perform the first unfold of an original unfolding symbol on a 15% chance. In other words, only 15% of original unfolding symbols will unfold at least once. Further, if a first unfold occurs, additional unfolds may also be subject to the fixed unfolding chance. In other words, gaming machine will only perform the second unfold of an original unfolding symbol on a 15% chance after determining that a first unfold occurs. As such, the chance of the having each subsequent unfold becomes more remote. In another embodiment, each level of unfold has a pre-defined chance of unfolding ("individual unfolding chance"). In other words, and for example, each first unfold may have a 70% chance to unfold, each second unfold may have a 50% chance to unfold (after a first unfold has occurred), each third unfold may have a 30% chance to unfold (after a second unfold has occurred), and so on (a decreasing chance of likelihood). In some embodiments, the individual unfold chances are an increasing chance of likelihood.

Figure 7:
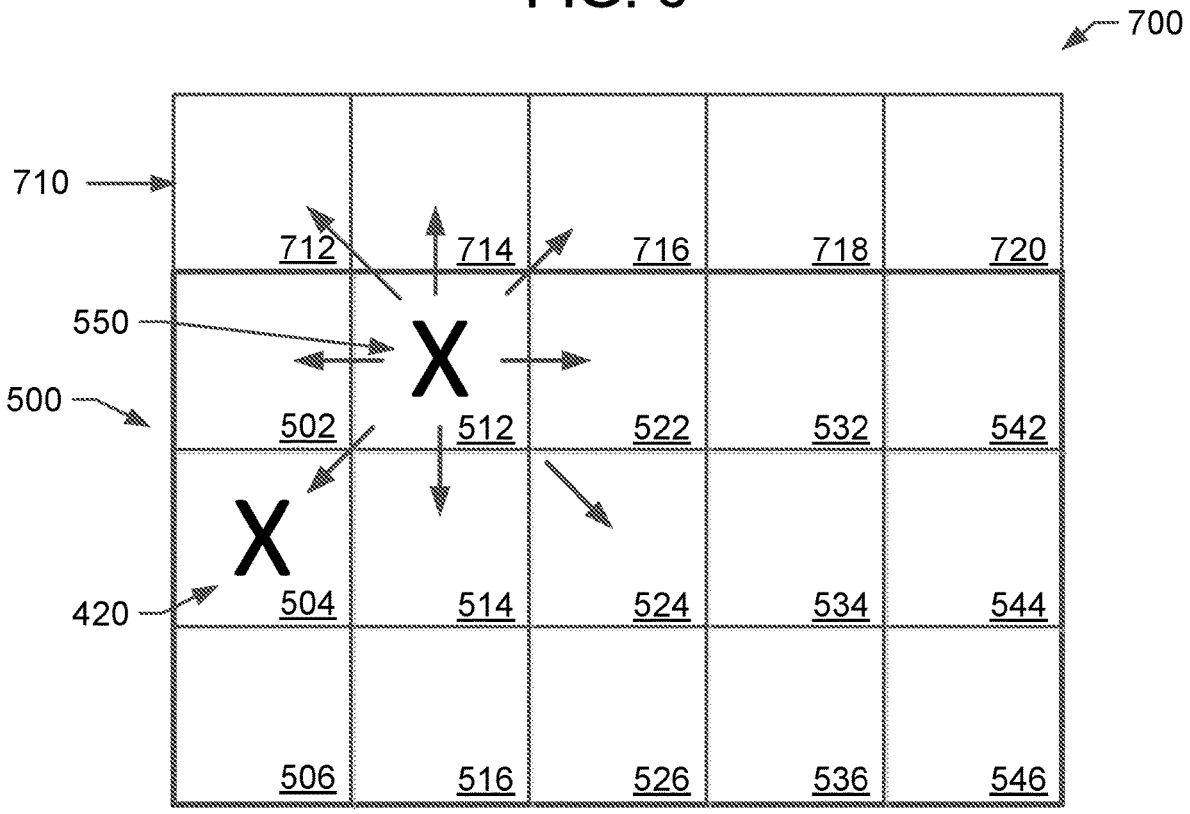
FIG. 7 is a screen view of a "expanding play area" embodiment described, by way of example, as a continuation of the exemplary game of chance described in reference to FIGS. 4 and 5.

FIG. 7 is a screen view 700 of a "expanding play area" embodiment described, by way of example, as a continuation of the exemplary game of chance described in reference to FIGS. 4 and 5. In this expanding play area embodiment, the overall dimensions of an initial play area begin, for example, as 3 rows high by 5 columns/reels wide as shown, for example, by screen view 500. After the spin, and, for example, during the unfolding process, the play area may expand, or increase size in one or more directions. In the example shown in FIG. 7, gaming machine 100 expands the play area displayed in screen view 700 by an additional expansion row 710 above the original play area. Play area expansion may be triggered in one or more ways. As used herein, the terms "play area" and "play field" are used to generally describe the positions of the one or more reels that are exposed or displayed to the player. As such, "expansion" of the play area, generally speaking, involves exposing one or more additional positions of the reels to the player during game play (e.g., during a spin, or during the unfolding process, prior to final evaluation of the game).

For example, in one embodiment, the original play area (screen view 500) may expand by including one or more additional positions when unfolding a particular unfolding symbol. More specifically, consider a continuation of the example described in reference to FIG. 5, as depicted by FIG. 7. In this example embodiment, gaming machine 100 includes not only the adjacent positions of unfolding symbol 550 (i.e., from position 512) to be the adjacent spaces on the original play area (screen view 500) (e.g., positions 522, 524, 514, 502, and optionally 504), but additionally the three adjacent spaces in expansion row 710 (expansion positions 712, 714, and 716). In other words, the potential unfolding position set additionally includes the expansion positions. If an expansion position is selected during the unfolding (e.g., during unfolding of additional unfolding symbol 550), then gaming machine 100 expands the play area with additional row 710 (e.g., gaming machine 100 draws additional row 710 on the gaming display).

In some embodiments, expansion row 710 positions 712, 714, 716, 718, and 780 are populated by the appropriate reel position. In other words, and for example, the addition of expansion row 710 causes gaming machine 100 to populate the next symbols of each of the five reels (e.g., the adjacent reel position to position 502, opposite to the reel position 504). In some embodiments, expansion row positions 712, 714, 716, 718, and 780 are populated, and gaming machine 100 unfolds any exposed unfolding symbols (i.e., any unfolding symbols that are displayed only because of the expansion). In still other embodiments, expansion row positions 712, 714, 716, 718, and 780 are blank (i.e., initially contain no symbol), but may be populated by an additional unfolding symbol. In still another embodiment, expansion may include only a single one to three positions, such as only a single position into which an unfolding symbol unfolds, or only positions adjacent to an existing unfolding symbol.

In another embodiment, the original play area may expand without requiring selection of an expansion position during an unfold. In one embodiment, whenever an unfolding symbol appears adjacent to a particular one or more borders of play area, gaming machine 100 may expand the play area (i.e., before expanding into the expansion area). For example, after unfolding original unfolding symbol 420 into position 512 (e.g., an edge position with the top side border), gaming machine 100 may immediately expand the play area (i.e., before processing the unfold of additional symbol 550). As such, player experience may be enhanced based on the anticipation and/or realization that additional pay lines and/or expansion symbol propagation are now possible.

In some embodiments, play area expansion may occur in only one or more particular directions, such as up and/or down (i.e., one or more rows above the top of the original play area, such as expansion row 710, and/or one or more rows below the bottom of original play area). In other embodiments, play area expansion may occur only up to a maximum number of times (e.g., once, or once in each direction).

In some embodiments, pay lines may be added and/or altered based on the expansion positions. In other words, additional pay lines may be possible based at least in part by the addition of, for example, expansion row 710. As such, play area expansion, facilitated at least in part by the unfolding process, serves to enhance excitement to the player and/or additional winning opportunities.

In the example embodiment, some or all of the steps of the unfolding process as described herein may be displayed in a time-delayed fashion, and slow enough such that the player may witness or watch one or more of the unfolding steps in sequence. For example, and using the unfolding example as described in relation to FIG. 6, gaming machine 100 may complete the initial spin at time t=0.0 seconds, visually highlight original unfolding symbol 420 in position 504 for 0.2 seconds (e.g., to visually attract the attention to the beginning of unfolding of that symbol), then display the additional unfolding symbol 550 in position 512 and highlight that symbol for 0.2 seconds, then display the additional unfolding symbol 650 in position 522 and highlight that symbol for 0.2 seconds. As such, play experience for the player may be enhanced by the player following the unfolding action.

In some embodiments, a single symbol is pre-defined (e.g., identified prior to spinning) as an unfolding symbol. In other embodiments, the player selects which symbol is an unfolding symbol. In still other embodiments, one or more symbols become unfolding symbols during game play. In one embodiment, a wild symbol is an unfolding symbol. In another embodiment, one or more symbols are randomly selected to be unfolding symbols.

In some embodiments, the final outcome of the unfolding process is pre-determined, or pre-scripted. For example, the gaming machine may pre-determine an award and/or a game outcome from a central game server, such as a Bingo server, sent to the game terminal. The final game outcome, instead of being displayed as a Bingo game result, may be displayed as a slot-machine like representation at the game terminal (e.g., spinning reels that sequentially stop), followed by an unfolding sequence that achieves this pre-determined outcome. In other words, the centrally determined Bingo game outcome is represented as a slot game with unfolding symbols. In other embodiments, the entire outcome of the game and the unfolding process may be randomly generated locally by a Random Number Generator (RNG) at the game terminal instead of a centralized server. For example, a slot game result may be identified or generated in real time at the game terminal, followed by an unfolding sequence that is also generated and presented in real time at the game terminal.

Figure 8:
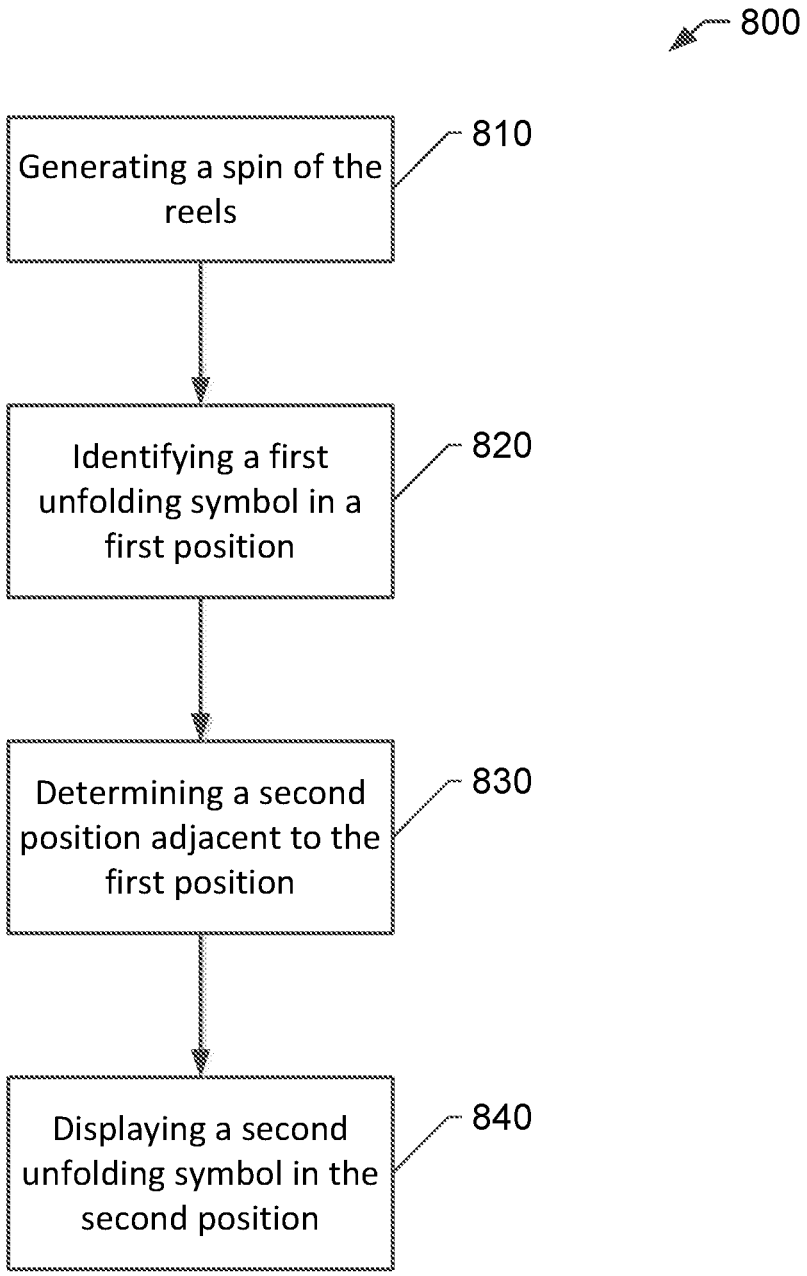
FIG. 8 is a flowchart that illustrates an exemplary method for providing a game of chance on the gaming machine shown in FIG. 1.

FIG. 8 is an exemplary method 800 for providing a game of chance on gaming machine 100 including unfolding symbols. In the exemplary embodiment, method 800 is performed by a computing device including a processor and a memory, such as gaming machine 100 shown and described in reference to FIGS. 1-3. In some embodiments, one or more operations in method 800 may be performed by one or more gaming machines 100, by gaming server 202 (shown in FIG. 2), and/or by any other computing device or combination thereof.

In the example embodiment, method 800 includes generating 810 a spin of the plurality of reels, the spin resulting in a play area including one or more symbols generated from each of the plurality of reels. Method 800 also includes identifying 820 a first unfolding symbol in a first position on the play area. Method 800 also includes determining 830 a second position on the play area adjacent to the first position. Method 800 also includes displaying 840 a second unfolding symbol in the second position on based at least in part on the determining, thereby unfolding the first unfolding symbol.

In some embodiments, method 800 also includes determining a set of adjacent spaces that are adjacent to the first position, and randomly selecting the second position from the set of adjacent spaces. In some embodiments, method 800 also includes displaying a third unfolding symbol in a third position adjacent to one or more of the first position and the second position on the play area. In some embodiments, method 800 also includes displaying a third unfolding symbol based in part on a random chance determination. In some embodiments, the unfolding symbol is pre-designated as a wild symbol. In some embodiments, method 800 includes determining the unfolding symbol during play based at least in part on the appearance of the unfolding symbol in a pre-determined position on the play area. In some embodiments, method 800 includes expanding the play area based at least in part on where, on the play area, the second unfolding symbol is displayed.

In some embodiments, method 800 also includes determining a set of adjacent spaces that are adjacent to the second position, the set of adjacent spaces including one or more adjacent spaces in an expansion area of the play area, selecting an adjacent space in the expansion area as the third position, thereby selecting an expansion position, and expanding the play area based at least in part on the selecting of the expansion position.

Figure 9:
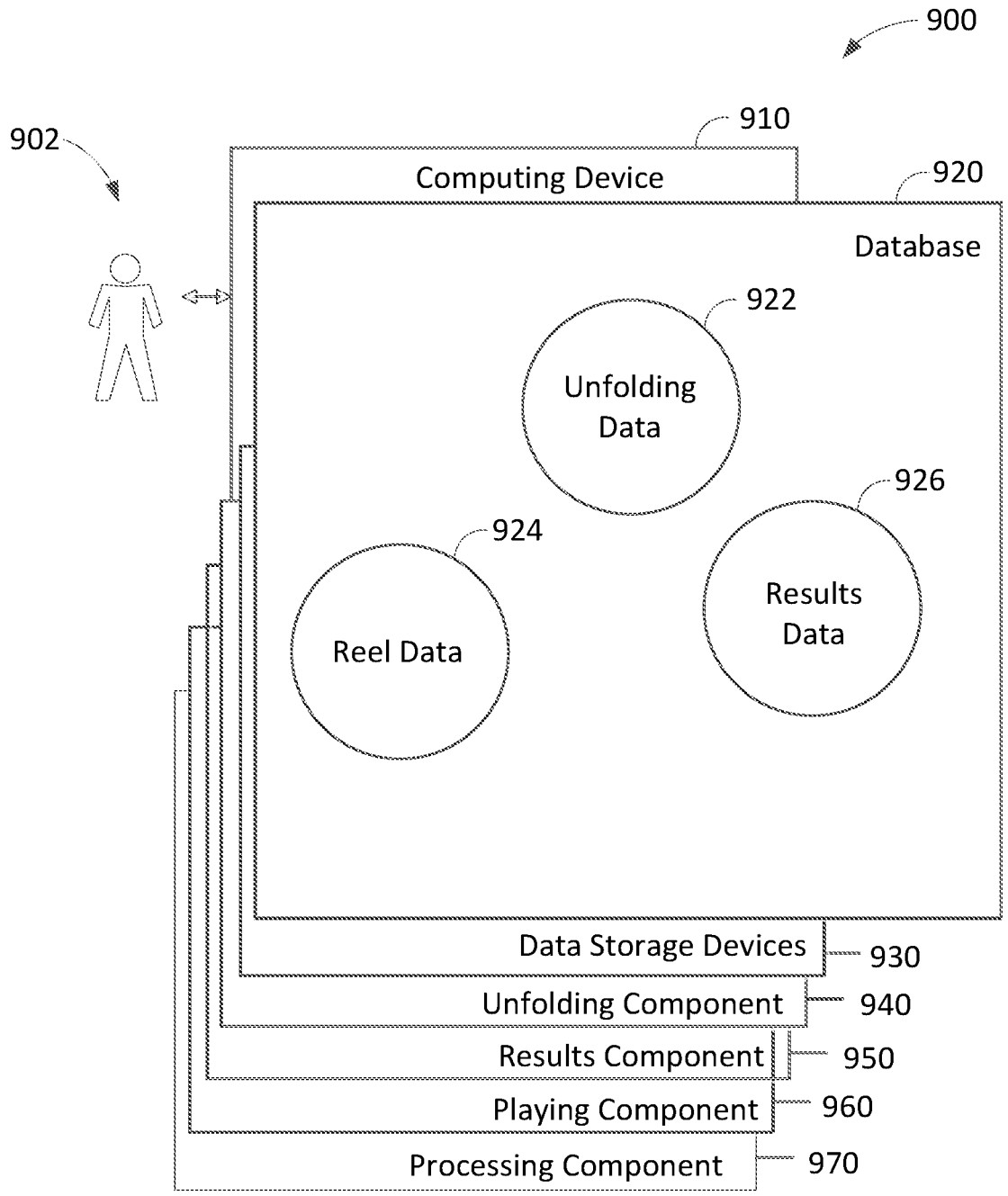
FIG. 9 shows an exemplary configuration of a database within a computing device, along with other related computing components, that provides a play of a base game that includes unfolding symbols.

FIG. 9 shows an exemplary configuration 900 of a database 920 within a computing device 910, along with other related computing components, that provides a play of a base game that includes unfolding symbols. In some embodiments, computing device 910 is similar to gaming machine 100 (shown in FIG. 1). Database 920 may be coupled to several separate components within computing device 910, which perform specific tasks.

In the example embodiment, database 920 includes unfolding data 922, reel data 924, and results data 926. In some embodiments, database 920 is similar to memory area 306 (shown in FIG. 3). Unfolding data 922 includes data such as unfolding symbol(s) and data related to unfolding symbols. Reel data 924 includes data such as a pre-defined circular sequence of symbols simulating a reel of a game of chance. Results data 926 includes information associated with results generated or determined for spins and/or unfolding during a game of chance.

Computing device 910 includes the database 920, as well as data storage devices 930. Computing device 910 also includes an unfolding component 940 for processing unfolds associated with unfolding symbols. Computing device 910 also includes a results component 950 for determining results of games of chance. An playing component 960 is also included for providing a game of chance to a user 902 (e.g., a player of the game of chance). A processing component 970 assists with execution of computer-executable instructions associated with the authentication system.

The systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming machine comprising:

a credit input mechanism, wherein the credit input mechanism comprises at least one of a bill acceptor, a coin acceptor, or a card reader;

a display device;

a processor coupled to the credit input mechanism and the display device; and a memory device storing instructions, which when executed by the processor, cause the processor to at least;

control the display device to display a plurality of reels within an initial active play area defined by a border, each of the plurality of reels comprising a plurality of symbol display positions;

establish a credit balance in response to a receipt of a credit input via the credit input mechanism;

initiate a play of a game in response to a wager derived from the credit balance;

control the display device to display, within the initial active play area defined by the border, results of a spin of the plurality of reels, the results including, for at least one of the plurality of symbol display positions for each of the plurality of reels, a symbol from a set of symbols;

detect that at least one of the displayed symbols in the results is a first instance of an unfolding symbol that is displayed in a first position, the first position being adjacent to the border of the initial active play area;

determine that a first unfolding of the first instance of the unfolding symbol should occur based on a first probability;

identify a currently hidden expanded play area based on the first position being adjacent to the border of the active play area, the expanded play area located outside of the border of the active play area; and control the display device to display an updated active play area, the updated active play area including both the initial active play area and the expanded play area.

2. The gaming machine in accordance with claim 1, wherein the instructions further cause the processor to determine that the first unfolding of the first instance of the unfolding symbol causes a second instance of the unfolding symbol to be displayed in a second position that is in the expanded play area.

3. The gaming machine in accordance with claim 1, wherein the instructions further cause the processor to display an additional row of symbol positions adjacent to the border, the additional row included in the expanded play area.

4. The gaming machine in accordance with claim 1, wherein the instructions further cause the processor to:

add an expansion symbol position for at least one of the plurality of reels into the expanded play area; and display a symbol from the at least one of the plurality of reels in the expansion symbol position.

5. The gaming machine in accordance with claim 1, wherein the instructions further cause the processor to:

add one or more expansion symbol positions into the expanded play area; and display a second instance of the unfolding symbol in a second symbol position of the one or more expansion symbol positions.

6. The gaming machine in accordance with claim 5, wherein the instructions further cause the processor to:

identify a potential unfolding position set including at least one adjacent position with respect to the expansion symbol position;

randomly select a third position in the updated active play area from the potential unfolding position set; and display a third instance of the unfolding symbol in the third position.

7. The gaming machine in accordance with claim 1, wherein the instructions further cause the processor to use at least one symbol display position in the expanded play area to evaluate an outcome of the wager on the play of the game.

8. The gaming machine in accordance with claim 1, wherein the unfolding symbol is pre-designated as a wild symbol.

9. The gaming machine in accordance with claim 1, wherein the instructions further cause the processor to determine the first unfolding during the play based at least in part on the appearance of the unfolding symbol in a predetermined position in the initial active play area.

10. The gaming machine in accordance with claim 1, wherein the instructions further cause the processor to determine that a second unfolding of a second instance of the unfolding symbol should occur based on a second probability.

11. A method for providing a game of chance on a gaming machine including a processor and a display device, the method comprising:

displaying an initial play area on the display device, the initial play area displaying a set of symbols on a plurality of reels, the initial play area representing an initial active play area defined by a border;

detecting, by the processor, a first instance of an unfolding symbol in a first position in the initial active play area, the first position being adjacent to the border of the initial active play area;

identifying, by the processor, a first potential unfolding position set including at least one symbol position adjacent to the first position, outside the border of the initial active play area and located within a currently hidden expanded play area;

selecting, by the processor, an unfolding position from the first potential unfolding position set; and in response to determining that the unfolding position is outside of the border of the initial active play area and within the currently hidden expanded play area, displaying an updated active play area including both the initial active play area and the expanded play area including at least the unfolding position.

12. The method in accordance with claim 11, further comprising displaying a second instance of the unfolding symbol in an expansion symbol position in the expanded play area.

13. The method in accordance with claim 11, wherein displaying an updated active play area comprises displaying an additional row of symbol positions outside of the border and adjacent to the border.

14. The method in accordance with claim 11, wherein displaying an updated active play area comprises displaying one or more symbols from the plurality of reels in one or more expansion symbol positions in the expanded play area.

15. The method in accordance with claim 11 further comprising:

identifying a second potential unfolding position set including at least one adjacent position with respect to the unfolding position;

randomly selecting a third position in the updated active play area from the second potential unfolding position set; and displaying a third instance of the unfolding symbol in the third position.

16. The method in accordance with claim 11 further comprising using at least one symbol display position in the expanded play area to evaluate an outcome of the wager of the play of the game.

17. The method in accordance with claim 11, wherein the unfolding symbol is pre-designated as a wild symbol.

18. The method in accordance with claim 11, wherein determining the first unfolding further includes determining the first unfolding during play based at least in part on the appearance of the unfolding symbol in a pre-determined position in the initial active play area.

19. The method in accordance with claim 11, wherein the processor is further configured to determine a second unfolding of a second instance of the unfolding symbol should occur based on a probability.

20. A gaming system comprising:

a gaming machine comprising:

a credit input mechanism, wherein the credit input mechanism comprises at least one of a bill acceptor, a coin acceptor, or a card reader; and a display device; and a server communicatively coupled to the gaming machine, the server comprising a processor coupled to the credit input mechanism and the display device, the processor programmed to:

control the display device to display an initial play area on the display device of the gaming machine, the initial play area displaying a set of symbols on a plurality of reels, the initial play area representing an initial active play area defined by a border;

detect a first instance of an unfolding symbol in a first position in the initial active play area, the first position being adjacent to the border of the initial active play area;

identify a first potential unfolding position set including at least one symbol position adjacent to the first position, outside the border of the initial active play area, and located within a currently hidden expanded play area;

select an unfolding position from the first potential unfolding position set; and in response to determining that the unfolding position is outside of the border of the initial active play area and within the currently hidden expanded play area, control the display device to display an updated active play area including both the initial active play area and the expanded play area including at least the unfolding position.

* * * * *